United States Patent [19]

Carlson

[11] Patent Number: 5,072,931

[45] Date of Patent: Dec. 17, 1991

[54] JUMP MEASURING DEVICE

[76] Inventor: Mylo M. Carlson, Rte. 3, Box 140, Angus, Minn. 56712

[21] Appl. No.: 662,424

[22] Filed: Feb. 28, 1991

[51] Int. Cl.[5] ..... A63B 69/00

[52] U.S. Cl. ..... 272/100; 273/1.5 A

[58] Field of Search ..... 273/1.5 R, 1.5 A, 391; 272/100, 101, 93, 109; 248/188.3, 600, 601, 354.1

[56] References Cited

U.S. PATENT DOCUMENTS

| | | | |
|---|---|---|---|
| 1,528,662 | 3/1925 | Ewing | 273/391 |
| 2,469,145 | 5/1949 | Baliff | 273/1.5 A X |
| 3,534,956 | 10/1970 | Myers | 273/1.5 A X |
| 4,036,494 | 7/1977 | Hayes | 273/1.5 R |
| 4,208,050 | 6/1980 | Perrine et al. | 273/1.5 A X |

*Primary Examiner*—Paul E. Shapiro

*Attorney, Agent, or Firm*—Zarley, McKee, Thomte, Voorhees & Sease

[57] ABSTRACT

A jump measuring device is provided which includes a vertically disposed support which is secured to the underside of a basketball rim and which is urged into engagement therewith by a spring loaded foot provided at the lower end of the vertically disposed support. A plurality of horizontally extending rods extend from the upper portion of the support and are deflected by the user so that the height to which the user has jumped is readily determined. Reset bars are provided at opposite sides of the rods to reset the rods between uses.

8 Claims, 4 Drawing Sheets

JUMP MEASURING DEVICE

BACKGROUND OF THE INVENTION

This invention relates to a jump measuring device and more particularly to a jump measuring device which indicates the vertical jumping ability of an athlete.

Many types of jump measuring apparatuses have been previously provided to measure the ability of an athlete to jump vertically from a standing or running position. For example, see U.S. Pat. No. 4,208,050.

The jump measuring device of this invention is believed to represent a significant advance in the art in that the device is easily transportable from one location to another. Further, the device of this invention is attached to a basketball rim at the 10 foot height so that the device will be stable during use. Additionally, prior art devices of which applicant is aware do not have any conveniently operable reset devices and do not readily indicate the height to which the athlete has jumped.

Therefore, it is a principal object of the invention to provide an improved jump measuring device.

Yet another object of the invention is to provide a jump measuring device which is easy to position in the operating position and is easy to transport.

Yet another object of the invention is to provide a jump measuring device including a plurality of horizontally extending rods which are deflected by the athlete and which may be easily reset.

Still another object of the invention is to provide a jump measuring device having height indicating means readily visible thereon.

Yet another object of the invention is to provide a jump measuring device which is safe to use.

Still another object of the invention is to provide a jump measuring device which is economical of manufacture, durable in use and refined in appearance.

These and other objects of the present invention will be apparent to those skilled in the art.

SUMMARY OF THE INVENTION

A jump measuring device is provided and includes a vertically disposed support which is comprised of an upper support portion mounted on a lower support portion. The lower end of the lower support portion has a spring loaded foot while the upper support portion has a bracket which is attached to the underside of a basketball rim or to supports positioned 10 feet above the floor. The spring loaded foot portion urges the bracket upwardly into engagement with the rim and maintains the apparatus in position during use. A plurality of horizontally disposed rods are pivotally secured to the upper support member about a vertical axis and extend outwardly therefrom. Rods at each six inch level are colored differently than the other rods to give the jumper an easily visible goal to achieve. The upper support portion also includes height indicators so that the height to which the athlete has jumped is readily determined. A pair of reset bars are provided on the upper support portion to reset the rods after each use.

DESCRIPTION OF THE PREFERRED EMBODIMENT

Figure 1:
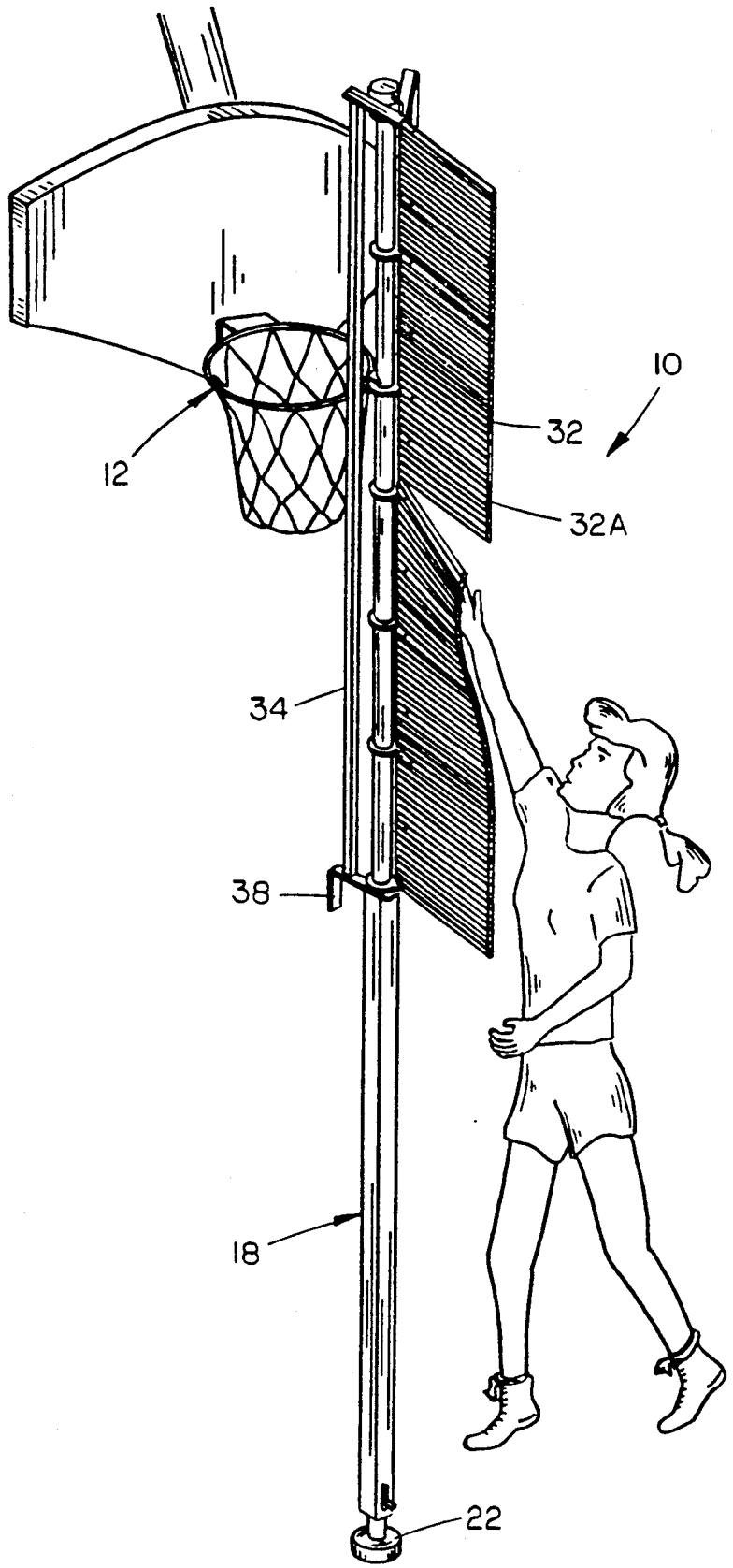
FIG. 1 is a perspective view illustrating the device of this invention being used.

The jump measuring device of this invention is referred to generally by the reference numeral 10, while the reference numeral 12 refers to a conventional basketball rim which is located ten feet above a supporting surface such as a floor 14 or the like. Although the device of this invention is preferably used in connection with a conventional basketball rim, it may be used with a suitable support which is positioned 10 feet above the floor which would have a ⅝" rod associated therewith to enable the device of this invention to be secured thereto. Device 10 includes a vertically disposed support means which is comprised of lower support member 18 having upper support member 20 threadably mounted at the upper end thereof. A spring loaded foot 22 is provided at the lower end of lower support member 18 for urging the support means 16 upwardly as will be described hereinafter.

Upper support member 20 is provided with an inverted U-shaped bracket 24 which extends therefrom at the 10 foot level and which is adapted to engage the underside of the rim 12 as illustrated in the drawings. Spring loaded foot 22 urges the bracket 24 upwardly into engagement with the rim 12 to maintain the device in position during use. If the device of this invention is not being used in combination with a basketball rim, bracket 24 would be positioned adjacent a suitable ⅝" rod on some other form of support which is positioned 10 feet above the floor surface.

Figure 2:
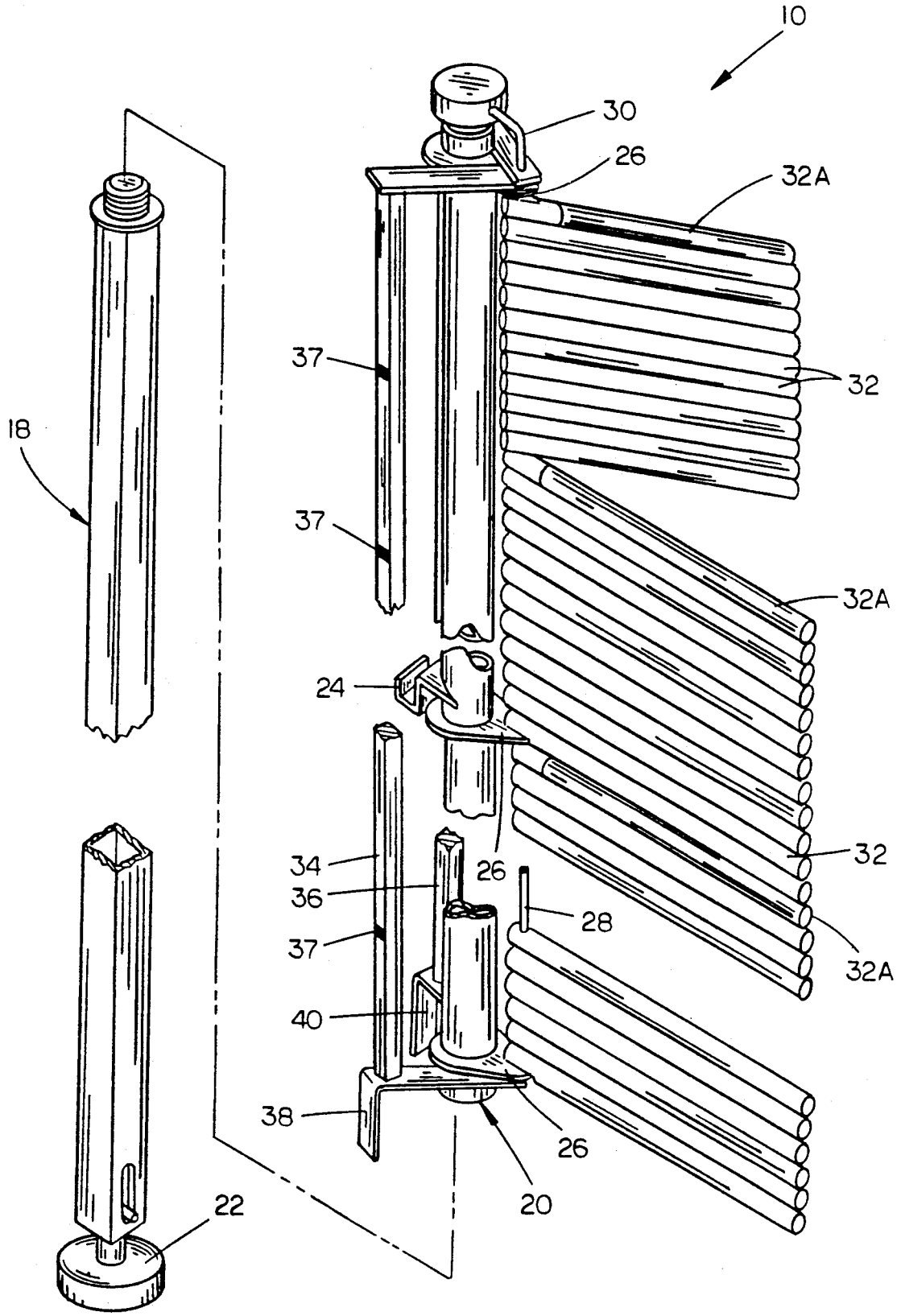
FIG. 2 is a partial exploded perspective view of the invention.
Figure 3:
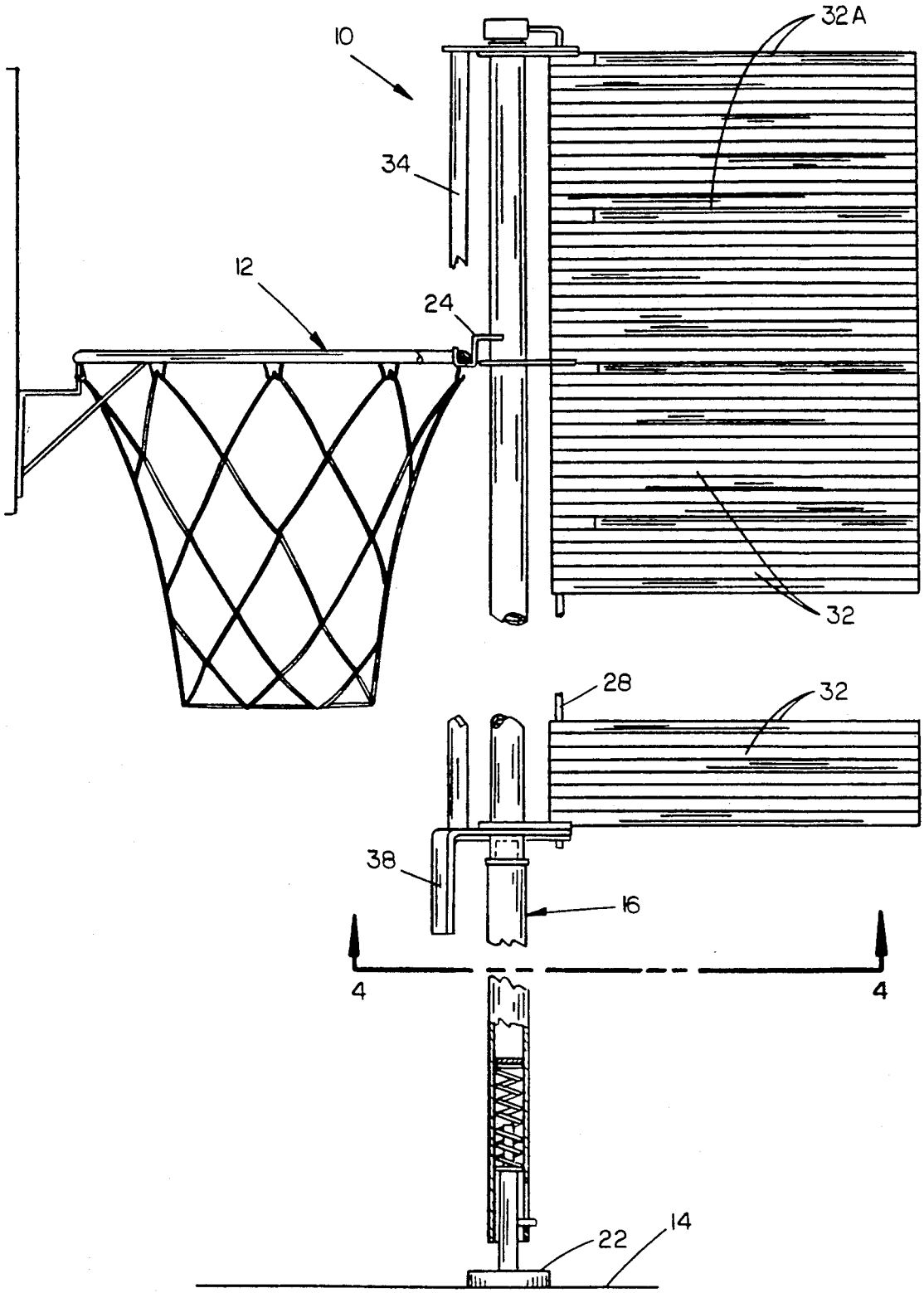
FIG. 3 is a partial side view of the invention with portions thereof cut away to more fully illustrate the invention.
Figure 5:
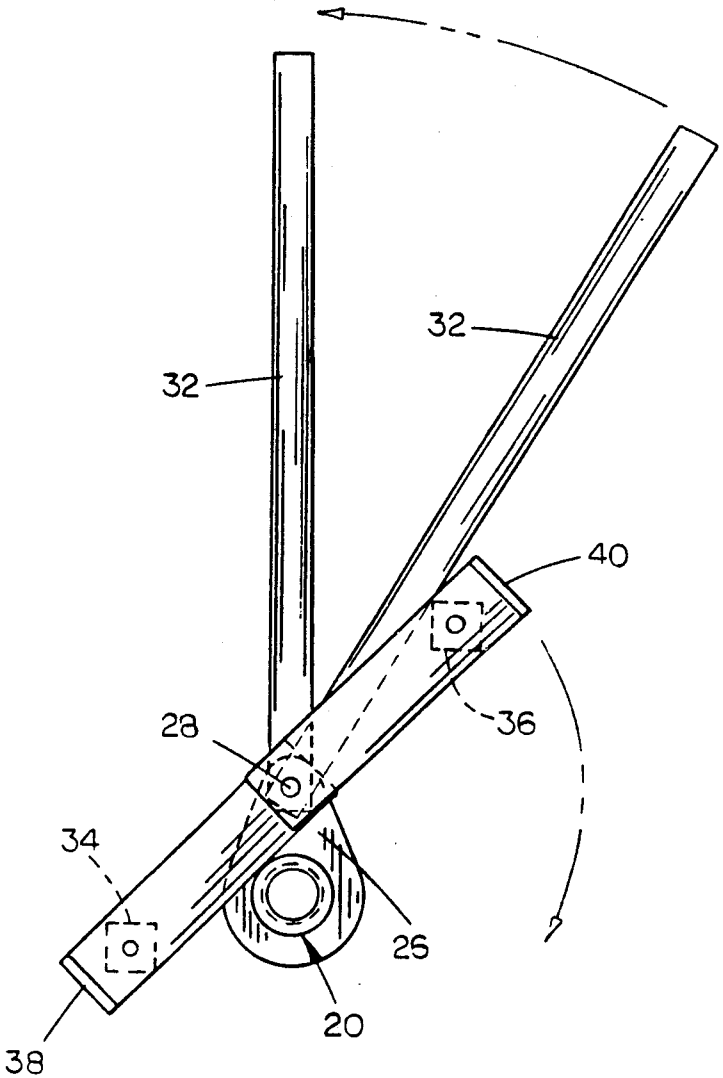
FIG. 5 is a sectional view similar to FIG. 4 except that one of the reset bars has been moved from the position of FIG. 4.
Figure 4:
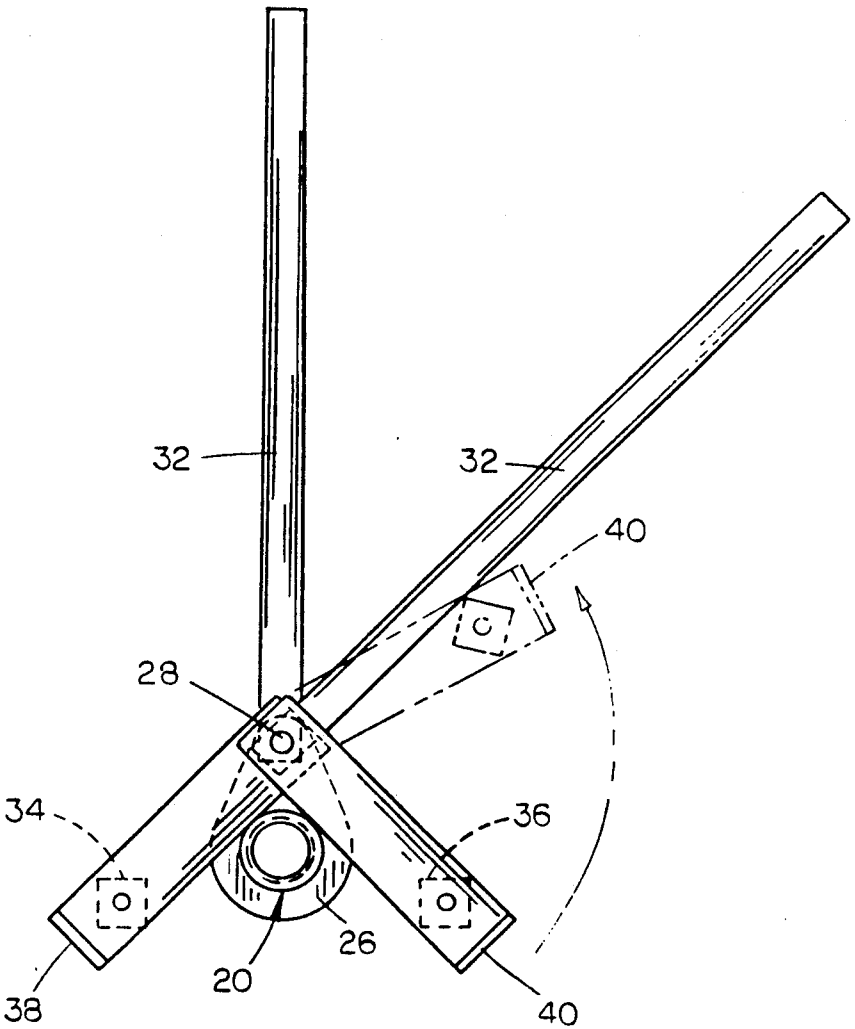
FIG. 4 is a sectional view as seen on lines 4—4 of FIG. 3.

A plurality of horizontally disposed plates 26 are secured to upper support member 20 and extend horizontally outwardly therefrom as seen in FIG. 2. Rod or shaft 28 is secured to and extends between the plates 26 and has its upper end 30 secured to the upper end of upper support member 20. A plurality of rods 32 which have a one-half inch diameter are pivotally supported, about a vertical axis, on the shaft 28 and extend outwardly from the support means as seen in the drawings. It is preferred that the rods 32 be colored white and that a black rod **32*a*** be provided at every six inches to provide an easily visible guide or goal for the user.

A pair of reset bars 34 and 36 are pivotally mounted on the shaft 28 on opposite sides of the rods 32 and are provided with handles 38 and 40 at the lower end thereof respectively. The reset bars 34 and 36 are provided with height indicating indicia 37 every six inches to provide a quick reference to which height was achieved. When the reset bars 34 and 36 are positioned closely adjacent the rods 32, the rods 32 cannot pivot and it is recommended that the reset bars 34 and 36 be so positioned during transport of the device. When it is desired to use the device, the reset bars 34 and 36 are pivoted away from the rods 32 so that the rods 32 may freely pivot when struck by the user's hand.

The device is installed as previously described and the user will jump from either a standing stop or a running start to reach as high on the rods 32 as possible. The rods struck by the user's hand will deflect or pivot horizontally with respect to the rods positioned thereabove. The colored rods 32 and 34*a* provide an easy determination of the height to which the jumper has reached.

The reset bars 34 and 36 are then pivotally moved towards one another to reset all of the rods 32 in the same vertical plane so that the apparatus may be used again. The height indicating indicia 37 on bars 34 and 37 also provide a quick reference as to which height was achieved.

Thus it can be seen that a novel jump measuring device has been provided which is not only stable during use but which is easily reset for subsequent usages. Thus it can be seen that the invention accomplishes at least all of its stated objectives.

I claim:

1. A jump measuring apparatus for measuring the ability of a person to jump vertically, comprising:

an elongated vertically disposed support means having a lower end in engagement with a floor surface, means connecting said support means to a basketball rim to stabilize said support means, a plurality of horizontally disposed and vertically spaced indicator rods pivotally secured to said support means, about a vertical axis, and extending outwardly therefrom, said indicator rods normally being disposed in the same vertical plane but being individually movable with respect to said support means when engaged by the hand of the jumping person using the apparatus.

2. The jump measuring apparatus of claim 1 wherein said means connecting said support means to the basketball rim comprises a U-shaped bracket which at least partially embraces the underside of the rim.

3. The jump measuring apparatus of claim 2 wherein said support means includes a spring loaded foot portion at its lower end which urges said U-shaped bracket upwardly into engagement with the rim.

4. The jump measuring apparatus of claim 1 wherein a vertically disposed reset means is pivotally secured to said support means, about a vertical axis, for resetting said indicator rods to their normal position after certain of the indicator rods have been moved by the jumper.

5. The jump measuring apparatus of claim 4 wherein said rest means comprises first and second reset bars positioned on opposite sides of said indicator rods and being selectively pivotally movable with respect thereto.

6. The jump measuring apparatus of claim 4 wherein height indicating means is provided on said reset means.

7. The jump measuring apparatus of claim 1 wherein predetermined indicator rods are colored differently than the other indicator rods for readily indicating certain heights.

8. A jump measuring apparatus for measuring the ability of a person to jump vertically, comprising:

an elongated vertically disposed support means having a lower end in engagement with a floor surface, a plurality of disposed vertically spaced indicator rods pivotally secured to said support means, about a vertical axis, and extending outwardly therefrom, said indicator rods normally being disposed in the same vertical plane but being individually movable with respect to said support means when engaged by the hand of the jumping person using the apparatus, and means stabilizing said support means, said means stabilizing said support means comprising a U-shaped bracket which extends therefrom and which is adapted to engage a supporting member.

* * * * *